US005427539A

United States Patent [19]

Saito

[11] Patent Number: 5,427,539

[45] Date of Patent: * Jun. 27, 1995

[54] LEVER TYPE CONNECTOR

[75] Inventor: Masashi Saito, Yokkaichi, Japan

[73] Assignee: Sumitomo Wiring Systems, Ltd., Yokkaichi, Japan

[ * ] Notice: The portion of the term of this patent subsequent to Jul. 12, 2011 has been disclaimed.

[21] Appl. No.: 164,440

[22] Filed: Dec. 9, 1993

Related U.S. Application Data

[63] Continuation-in-part of Ser. No. 78,120, Jun. 18, 1993, Pat. No. 5,328,377.

[30] Foreign Application Priority Data

Jul. 13, 1992 [JP] Japan ..... 4-048814 U
Dec. 28, 1992 [JP] Japan ..... 4-089403 U

[51] Int. Cl.[6] ..... H01R 13/00
[52] U.S. Cl. ..... 439/157; 439/372
[58] Field of Search ..... 439/157, 152, 153, 159, 439/160, 310, 372

[56] References Cited

U.S. PATENT DOCUMENTS 5,135,410 8/1992 Kawase et al. .
5,172,998 12/1992 Hatagishi ..... 439/157
5,174,785 12/1992 Endo et al. ..... 439/157
5,178,553 1/1993 Hatagishi et al. ..... 439/157
5,230,635 7/1993 Takenouchi et al. .
5,269,696 12/1993 Okada et al. .
5,328,377 7/1994 Saito ..... 439/157

FOREIGN PATENT DOCUMENTS 0459448 12/1991 European Pat. Off. .
56877 2/1990 Japan ..... 439/157
4-62772 2/1992 Japan .
2179506 3/1987 United Kingdom .

OTHER PUBLICATIONS

English Language Abstract of JP-4-62772.

*Primary Examiner*—Daniel W. Howell
*Attorney, Agent, or Firm*—Sandler, Greenblum & Bernstein

[57] ABSTRACT

A lever type connector, comprising: a pair of a first connector and a second connector to be connected with each other, in which a lever is rotatably supported by a pair of supporting shafts on the first connector; a pair of guide pins which engage each of a pair of guide grooves formed on the lever project from the second connector; and the lever is rotated to move the second connector into the first connector so as to connect the first and second connectors with each other or move the second connector away from the first connector so as to disconnect the first and second connectors from each other due to the engagement between the guide pins and the guide grooves, thereby to reduce the horizontal distance between the supporting shaft and an end of the lever, thus making the lever compact.

4 Claims, 5 Drawing Sheets

LEVER TYPE CONNECTOR

This is a continuation-in-part application of U.S. patent application No. 08/078,120 filed on Jun. 18, 1993, now U.S. Pat. No. 5,328,377 the disclosure of which is herein incorporated by reference in its entirety.

BACKGROUND OF THE INVENTION

1. Field of the Invention

The present invention relates to a lever type connector and more particularly to a lever type connector comprising a pair of connectors connected with each other by using a lever rotatably supported by a pair of shafts projecting from one of the connectors.

2. Description of the Related Arts

A great force is required to connect a plurality of connectors, for example, 20 or more with each other. Therefore, lever type connectors have been proposed to connect them easily by means of a lever which allows an operator to connect them by applying a relatively small force thereto.

Referring to FIG. 6, an example of the above-described conventional lever type connector is described below. A U-shaped lever 3 is rotatably supported by a pair of supporting shafts 4 and 4 on both side surfaces of a connector 1. A pair of guide pins 5 and 5 engaging each of guide grooves 3*a* and 3*a* of the lever 3 projects from a connector 2. The lever 3 is rotated in a direction to move the connector 2 into the connector 1 so as to connect them with each other due to the engagement between the guide pans 5 and 5 of the connect 2 and each of the guide grooves 3*a* and 3*a* of the connector 1. In order to disconnect the connectors 1 and 2, the lever 3 is rotated in the opposite direction.

In connecting the connectors 1 and 2 of the above-described lever type connector with each other, an operator holds the connector 2 in one hand to engage the connectors 1 and 2 with each other while the operator rotates the lever 3 by the other hand. The following connector eliminates the need for using both hands in connecting them with each other. That is, the operator rotates the lever 3 by one hand with the connector 2 held by the connector 1 in a temporary engaging position. In the temporary engaging position, the connectors 1 and 2 are not in contact with each other and thus electrically unconductive to each other.

As shown in FIGS. 7 and 8A, in the conventional lever type connector, however, the guide pin 5 of the connector 2 and the supporting shaft 4 of the lever 3 are in the same level both in the temporary engaging position and the engaging position.

This construction leads to the formation of a large lever and thus a large connector.

That is, as shown in FIG. 8A, this construction requires a stroke S1 between a position P1 of the guide pin 5 in the temporary engaging position and a position P2 of the guide pin 5 in the engaging position; a distance L1 between the position P2 and the supporting shaft 4; and a distance L2 between an end 3*f* of the lever and the position P1. Therefore, a length (S1+L1+L2) is required horizontally between the supporting shaft 4 and the end 3*f* of the lever 3. Thus, the lever is large and thus a comparatively great force is operate to rotate the lever.

SUMMARY OF THE INVENTION

It is accordingly an object of the present invention to provide a compact lever so as to form a compact connector and operate the lever with a small force.

In accomplishing these and other objects of the present invention, there is provided a lever type connector, comprising: a pair of a first connector and a second connector to be connected with each other, in which a lever is rotatably supported by a pair of supporting shafts on the first connector; a pair of guide pins which engage each of a pair of guide grooves formed on the lever project from the second connector; and the lever is rotated to move the second connector into the first connector so as to connect the first and second connectors with each other or move the second connector away from the first connector so as to disconnect the first and second connectors from each other due to the engagement between the guide pins and the guide grooves. In this construction, the vertical position of each supporting shaft of the first connector and that of each guide pin of the second connector are differentiated from each other at a connector-engaging position.

Each guide pin engages the corresponding guide groove with the vertical position of the guide pin and that of the supporting shaft differentiated from each other in a side opposite to the operation portion, of the lever, disposed between the side surfaces thereof.

Projections are formed on guide grooves of the lever. The projections convert the rotation of the lever in an engaging direction about the guide pins into the rotation thereof in a disengaging direction, when the guide pins are brought into contact with the guide grooves at the temporary engaging position.

According to the above construction, because the vertical position of the lever-supporting shaft and that of the guide pin are different from each other, the minimum distance L1 between the position P2 of the guide pin at the engaging position and the position of the lever-supporting shaft can be taken vertically as well as horizontally as shown in FIG. 8B. Therefore, the minimum distance between the position P2 of the guide pin and the position of the lever-supporting shaft is $L1 \times \sin\alpha$.

Compared with the conventional construction in which the position of the guide pin and that of the lever-supporting shaft is set in the same level as shown in FIG. 8A, the construction according to the present invention makes the horizontal distance between the lever-supporting shaft and the end of the lever shorter by $L1(1-\sin\alpha)$ even though both the conventional lever and the lever according to the present invention have the same stroke S1 between the position P1 of the guide pin 5 in the temporary engaging position and the position P1 thereof in the engaging position.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
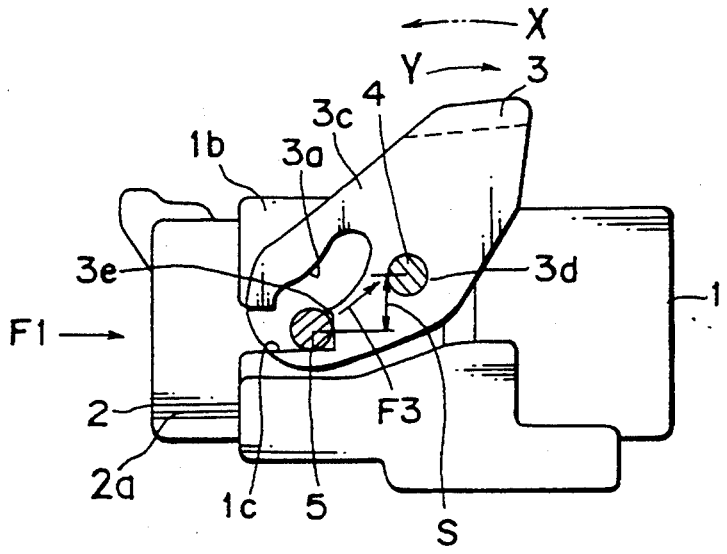
FIG. 1 is a side view showing a lever type connector according to an embodiment of the present invention.

Before the description of the present invention proceeds, it is to be noted that like parts are designated by like reference numerals throughout the accompanying drawings.

Figure 6:
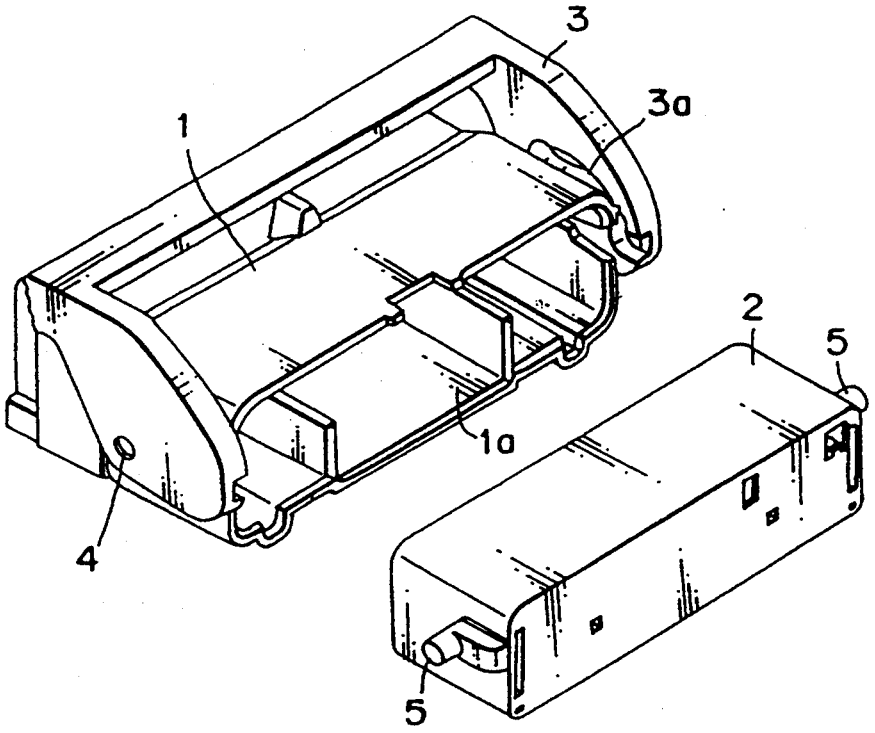
Fig. 6 PRIOR ART
FIG. 6 is a perspective view showing a conventional lever type connector.
Figure 7:
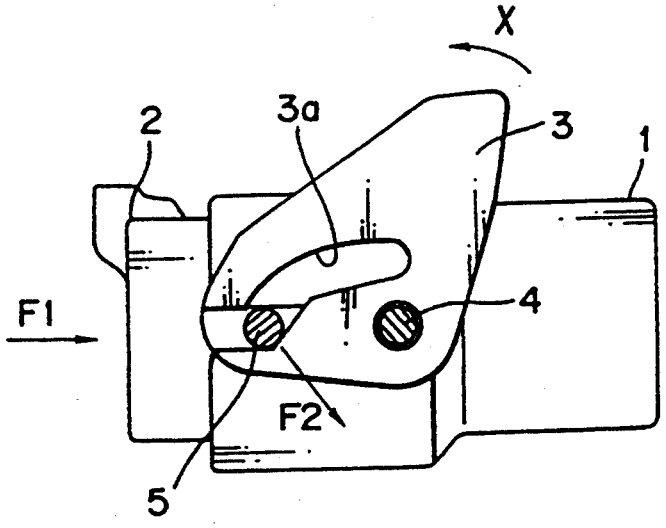
Fig. 7 PRIOR ART
FIG. 7 is a side view showing the conventional lever type connector.

Referring to FIG. 1, in a lever type connector, a lever 3 is installed on a female connector 1. The female connector 1 having a plurality of terminal-accommodating chambers (not shown) is connected with a male connector 2 by inserting the male connector 2 into the female connector 1 from the front edge of the female connector 1 through an opening 1*a* (see FIG. 6).

A pair of supporting shafts 4 and 4 integral with the female connector 1 and projecting from both side walls 1*b* and 1*b* thereof is engagingly inserted into each of openings 3*d* and 3*d* formed on a pair of side walls 3*c* and 3*c* of the lever 3. In this manner, the lever 3 is rotatably supported by the female connector 1.

Each of the supporting shafts 4 and 4 is formed on the outer surface of each of the side walls 1*b* and 1*b* of the female connector 1 at a position above the center thereof in a vertical direction thereof. A pair of guide grooves 1*c* and 1*c* is formed, on the inner surface of each of the side walls 1*b* and 1*b*, inward from the front edge of the opening 1*a* of the female connector 1. Each of a pair of guide pins 5 and 5 formed on the male connector 2 is inserted into each of the guide grooves 1*c* and 1*c* and guided therethrough into the female connector 1. The guide grooves 1*c* and 1*c* are disposed at the center of the side walls 1*b* and 1*b* of the female connector 1 in a vertical direction thereof.

Each of a pair of circular arc guide grooves 3*a* and 3*a* is formed on the inner surface of each of the side walls 3*c* and 3*c*. Each of the guide grooves 3*a* and 3*a* is engaged by each of the guide pins 5 and 5 of the male connector 2.

Each of the guide pins 5 and 5 projects from the center of the outer surface of each of the side walls 2*a* and 2*a* so that the guide pins 5 and 5 and the guide grooves 1*c* and 1*c* of the female connector 1 are in the same level.

The level of the supporting shafts 4 and 4 of the lever 3 is different by a distance (S) from that of the guide pins 5 and 5, when the guide pins 5 and 5 of the male connector 2 engages the guide grooves 1*c* and 1*c* of the female connector 1, respectively.

Before the lever 3 is rotated to connect the female connector 1 and the male connector 2 with each other, the guide pins 5 and 5 are inserted into the guide grooves 1*c* and 1*c* of the female connector 1, respectively to hold the male connector 2 at a temporary engaging position as shown in FIG. 1. Each of the guide pins 5 and 5 contacts each of a pair of projections 3*e* and 3*e* formed on each of the guide grooves 3*a* and 3*a* of the lever 3 at the temporary engaging position of the male connector 2.

Figure 2:
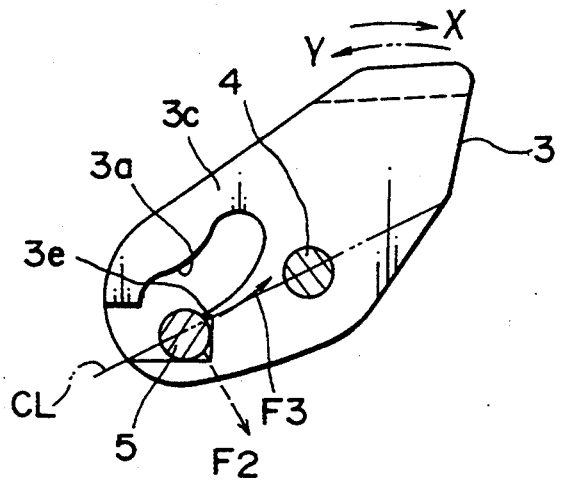
FIG. 2 is an enlarged side view showing a lever according to an embodiment of the present invention.
Figure 3:
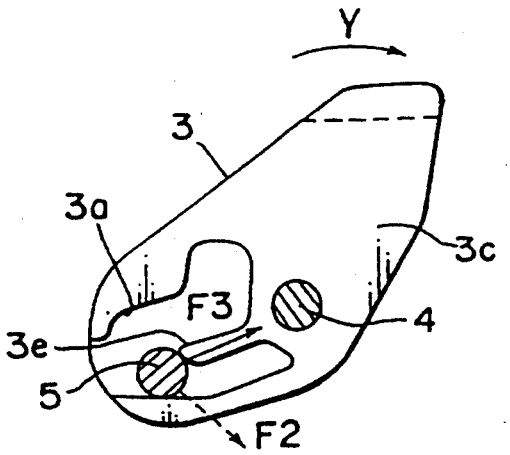
FIG. 3 is an enlarged side view showing a lever according to a modification of the present invention.

The projections 3*e* and 3*e* serve as a means for converting the rotation of the lever 3 in an engaging direction X about the guide pins 5 and 5 into the rotation thereof in a disengaging direction Y. That is, as shown in detail in FIG. 2, when the guide pin 5 guided by the guide groove 1*c* of the female connector 1 is brought into contact with the projection 3*e*, the projection 3*e* is disposed above a center line CL connecting the guide pin 5 and the center of the supporting shaft 4 with each other. Consequently, the guide pin 5 applies to the lever 3 not a rotational force F2 in the engaging direction X unlike in the conventional lever type connector but a rotational force F3 in the disengaging direction. The projection 3*e* may be in an elongated configuration as shown in FIG. 3.

In the lever type connector having the above-described construction, the vertical position of the supporting shaft 4 is differentiated from that of the guide pin 5 in connecting the female connector 1 and male connector 2 with each other. This construction allows the lever 3 to be more compact than the conventional one as shown in FIG. 4A and 4B.

Figure 4A:
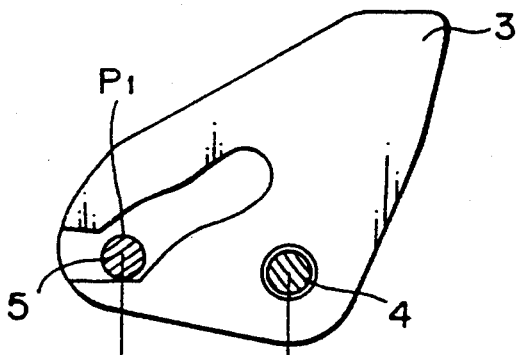
Fig. 4A PRIOR ART
FIGS. 4A and 4B are schematic views showing a conventional lever and a lever according to the present invention, respectively for comparison.
Figure 4B:
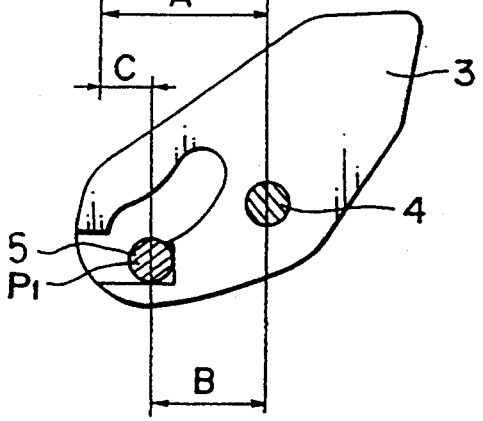
Figure 5:
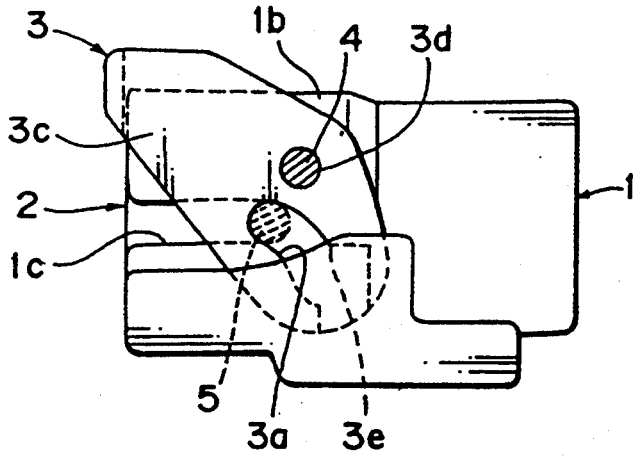
FIG. 5 is a side view showing the lever type connector, according to the present invention, in an engaging position.
Figure 8A:
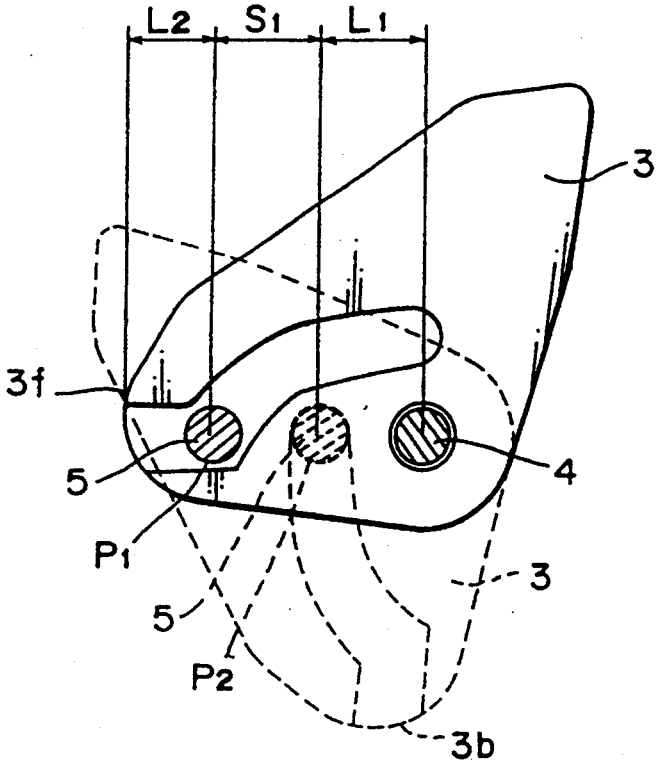
Fig. 8A PRIOR ART
FIGS. 8A and 8B are schematic views showing the difference between a lever of a conventional lever type connector and a lever according to the present invention, namely, the difference between the height of a supporting shaft and that of a guide pin of the former and the former.
Figure 8B:
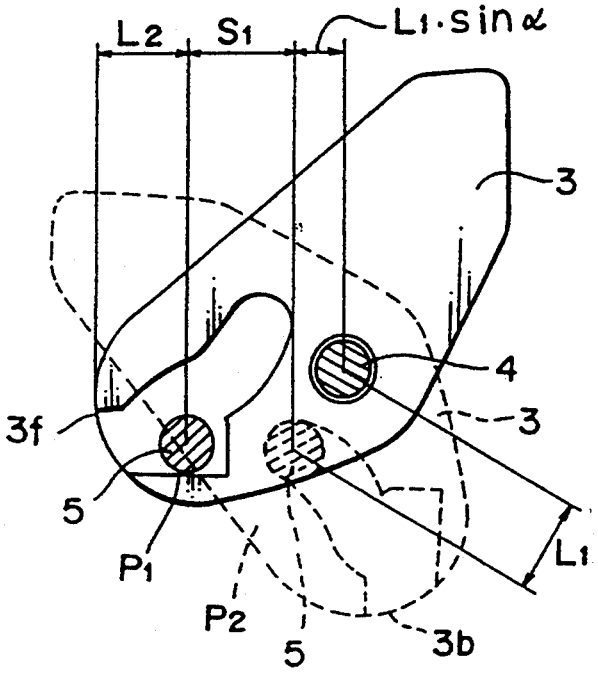

That is, as shown in FIG. 4A, the distance (A) between the supporting shaft 4 and the position P1 of the guide pin 5 in the temporary engaging position is as follows: $A=S1$ and $L1$ as shown in FIG. 8A. In the lever according to the present invention, the horizontal distance (B) between the supporting shaft 4 and the position P1 of the guide pin 5 in the temporary engaging position is as follows: $B=S1+L1\times\sin\alpha$ as shown in FIGS. 4B and 8B.

Accordingly, the difference between the distance (A) and the distance (B) is as follows: $C=A-B=L1(1-\sin\alpha)$.

Because the position of the supporting shaft 4 is higher than that of the guide pin 5 in the engaging position, the distance between the supporting shaft 4 and the left end of the lever 3 can be reduced by $L1(1-\sin\alpha)$, compared with the conventional construction in which the position of the guide pin 5 and that of the supporting shaft 4 are set in the same level, even though both the conventional lever and the lever according to the present invention have the same stroke S1 between the position P1 of the guide pin 5 in the temporary engaging position and the position P1 thereof in the engaging position.

Because the lever according to the present invention is smaller than the conventional lever, the former can be operated with a smaller force and thus a connector according to the present invention is smaller than the conventional connector.

If a rotational force F1 in the engaging direction acts on the male connector 2 erroneously when the male connector 2 is at the temporary engaging position, the guide pin 5 is brought into contact with the projection 3*e* formed on the guide groove 3*a* of the lever 3. As a result, the projection 3*e* converts the rotational force F2 acting on the lever 3 in the engaging direction into the rotational force F3 acting thereon in the disengaging direction. Consequently, the lever 3 is prevented from rotating in the engaging direction. Accordingly, the male connector 2 can be prevented from being moved into the female connector 1 from the temporary position. That is, the male connector 2 remains held at the temporary position.

The distance between the position P1 of the guide pin 5 in the temporary engaging position and the position P2 thereof in the engaging position is considerably long. Therefore, the terminals of the female connector 1 and the male connector 2 are not brought into contact with each other and thus, they can be prevented from being conductive.

If an operator forgets to rotate the lever 3 to move the male connector 2 to the engaging position, i.e., if the operator forgets to engage the male connector 2 with the female connector 1, it can be reliably detected in a conductivity test that the terminal of the male connector 2 is not brought into contact with that of the female connector 1. That is, the female connector 1 has not been engaged by the male connector 2 at the engaging position.

The rotation of the lever 3 at the temporary engaging position allows the female connector 1 to be engaged by the male connector 2 at the main engaging position due to the engagement between the guide pin 5 of the male connector 2 and the guide groove 3*a* of the lever 3. That is, only the rotation of the lever 3 enables the female connector 1 to be engaged by the male connector 2 at the main engaging position.

As apparent from the foregoing description, in the lever type connector according to the present invention, the vertical position of the lever-supporting shaft installed on the female connector and that of the guide pin installed on the male connector are different from each other in the engaging position including the temporary engaging position and the engaging position. In this manner, the horizontal distance between the guide pin at the engaging position and the supporting shaft can be made to be small. This construction allows the lever to be more compact than the conventional one. Because the lever according to the present invention is smaller than the conventional lever, the former can be operated with a smaller force and thus a connector according to the present invention is smaller than the conventional connector.

The projection formed on the guide groove of the lever converts the rotation of the lever in the engaging direction about the guide pin which has engaged the guide groove of the lever into the rotation thereof in the disengaging direction. If force in the engaging direction acts on the male connector erroneously when the male connector is at the 10 temporary engaging position, the guide pin is brought into contact with the projection formed on the guide groove. As a result, the lever is prevented from rotating in the engaging direction. Accordingly, the male connector can be prevented from being moved into the female connector from the temporary position. Accordingly, even though an operator forgets to rotate the lever, i.e., even though the operator forgets to engage the male connector with the female connector at the engaging position, it can be reliably detected in a conductivity test that the terminal of the male connector is not brought into contact with that of the female connector. That is, the female connector has not been engaged by the male connector at the engaging position.

Although the present invention has been fully described in connection with the preferred embodiments thereof with reference to the accompanying drawings, it is to be noted that various changes and modification are apparent to those skilled in the art. Such changes and modifications are to be understood as included within the scope of the present invention as defined by the appended claims unless they depart therefrom.

What is claimed is:

1. A lever type connector comprising: a first connector and a second connector to be connected with each other, in which a lever is rotatably supported by a pair of supporting shafts on the first connector; a pair of guide pins which engage each of a pair of guide grooves formed on the lever, said pair of guide pins projecting from the second connector; the lever being rotated in a predetermined engaging direction to move the second connector into the first connector so as to connect the first and second connectors with each other or in a direction opposite to the predetermined engaging direction to move the second connector away from the first connector so as to disconnect the first and second connectors from each other due to the engagement between the guide pins and the guide grooves, the vertical position of each supporting shaft of the first connector and that of each guide pin of the second connector are differentiated from each other at a connector-engaging position; and a projection being formed on each of the guide grooves of the lever, each said projection converting rotation of the lever in said direction opposite to the predetermined engaging direction when the guide pins are brought into contact with each of the projections when the male connector is held at a temporary engaging position thereof.

2. A lever type connector as defined in claim 1, wherein each guide pin engages the corresponding guide groove with the vertical position of the guide pin and that of the supporting shaft differentiated from each other in a side of the lever opposite to an operation portion of the lever, the guide grooves being disposed between side surfaces of the lever.

3. A lever type connector as defined in claim 1, wherein the guide pins are inserted into respective guide grooves in an engaging direction, and a line connecting a respective supporting shaft and guide pin, when the guide pin is in contact with the projection, being at an angle to the engaging direction.

4. A lever type connector as defined in claim 1, wherein each said projection is located above a line connecting a respective supporting shaft and guide pin when the guide pin is in contact with the projection.

* * * * *